US009325114B2

(12) United States Patent
Miklinski et al.

(10) Patent No.: US 9,325,114 B2
(45) Date of Patent: Apr. 26, 2016

(54) PLUG CONNECTOR

(75) Inventors: Richard Miklinski, Aurora, IL (US); Kevin Benes, Chicago, IL (US); Paul Christopher Berg, Batavia, IL (US); Adam Pilecki, Glenview, IL (US)

(73) Assignee: Molex, LLC, Lisle, IL (US)

( * ) Notice: Subject to any disclaimer, the term of this patent is extended or adjusted under 35 U.S.C. 154(b) by 487 days.

(21) Appl. No.: 13/819,533

(22) PCT Filed: Sep. 1, 2010

(86) PCT No.: PCT/US2010/047513

§ 371 (c)(1),
(2), (4) Date: May 9, 2013

(87) PCT Pub. No.: WO2012/030335

PCT Pub. Date: Mar. 8, 2012

(65) Prior Publication Data

US 2015/0311633 A1 Oct. 29, 2015

(51) Int. Cl.
*H01R 13/639* (2006.01)
*H01R 13/627* (2006.01)
(Continued)

(52) U.S. Cl.
CPC ..... *H01R 13/639* (2013.01); *H01R 13/506* (2013.01); *H01R 13/6273* (2013.01); *H01R 13/703* (2013.01)

(58) Field of Classification Search
CPC ..... H01R 13/627; H01R 13/639; H01R 13/6273; H01R 13/506
USPC ..... 439/352, 188, 345, 350, 357, 358, 282
See application file for complete search history.

(56) References Cited

U.S. PATENT DOCUMENTS 5,616,045 A 4/1997 Gauker
6,364,683 B1 * 4/2002 Kohno ..... 439/352
(Continued)

FOREIGN PATENT DOCUMENTS

EP 0 591 948 B1 1/1997
EP 1 006 621 B1 1/2005
EP 2 026 421 B1 6/2010

OTHER PUBLICATIONS

International Search Report for PCT/US2010/047513.

*Primary Examiner* — James Harvey
*Assistant Examiner* — Oscar C Jimenez
(74) *Attorney, Agent, or Firm* — Clarence R. Moon

(57) ABSTRACT

A plug connector for cooperation with a socket connector (9) comprises a plug housing (2) having latch arms (22) with an end lug (29) for cooperation with an appropriate groove (95) in the socket connector (9), and being formed with a pair of split cross ribs (26) forming a gap (26*a*) therebetween. A CPA member (5) is provided for locking the connectors (1, 9) when mated, and comprises a pair of locking legs (50) and a pair of spring arms (53). The spring arms (53) each has a free end lug (54) and a nose (55) which projects inwardly so that, when the CPA member (5) and the plug connector (1) are in a pre-locked position, the nose (55) takes a short distance (d) to a support surface (20*a*) of the connector housing (20), and when there is a load well in excess of the mating a force onto the CPA member (5) in this condition, the noses (55) make a stop on the support surface (20*a*) to keep the CPA member (5) in the pre-locked position. When there is an excessive force placed on the CPA member, the spring arms (53) may slip into the gaps (26*a*) to prevent damaging of the CPA member (5).

12 Claims, 9 Drawing Sheets

(51) Int. Cl.
*H01R 13/703* (2006.01)
*H01R 13/506* (2006.01)

(56) References Cited

U.S. PATENT DOCUMENTS 6,530,799 B2 3/2003 Regnier et al.
7,108,539 B2 * 9/2006 Gunreben et al. ..... 439/352
7,108,542 B2 * 9/2006 Ishiwa ..... 439/489
7,556,516 B2 * 7/2009 Osada et al. ..... 439/188
7,578,694 B2 * 8/2009 Takahashi et al. ..... 439/352
8,317,545 B2 * 11/2012 Iida ..... 439/620.15
2004/0166715 A1 8/2004 Parrish et al.

* cited by examiner

PLUG CONNECTOR

FIELD OF THE INVENTION

The invention relates to a plug connector for cooperation with a socket connector and particularly to a squib connector for use in an automotive airbag restraint system.

Such vehicle airbag systems use an electrical connection system which comprises a receptacle or socket connector on the side of the airbag and a plug connector on the side of a control unit. These connectors have to be mated while fulfilling safety requirements relating to electrical safety and mechanical safety.

DESCRIPTION OF PRIOR ART

Electrical connectors for airbags are known from EP 0 591 948 B1 and include a socket connector having a shorting insert, and a plug connector having a safety leg for mechanically locking the connectors mated, and simultaneously breaking the shorting condition in the socket connector.

There are further developments in the electrical connection system with safety interlock which are termed "secondary locking device" or "CPA member" (connector position assurance). One of these developments can be found in U.S. Pat. No. 6,530,799 B2. The plug connector has a plug projection with locking arms fixed on the end of the plug projection and extending upwardly and forming a slot between locking arm and plug projection. The secondary locking device has several legs, among them a locking leg, a short circuit releasing leg and a spring arm with a step and a projection. The secondary locking device can be inserted into an upper face of the plug connector to take a pre-locked position wherein the step of the spring arm rests on a wedge-shaped crest projecting from the locking arm of the plug projection, and a locking projection formed on the plug connector housing. The locking arms of the plug connector which extend upwardly can be partly inserted into the socket connector to take a pre-mounted position of the plug connector and socket connector. When the plug connector is fully inserted into the socket connector, the spring arm is deflected by the locking projection acting against the step so that the spring arm bends, whereby the step is lifted from the locking projection. This allows a further depression of the secondary locking device where the projection of the spring arm slides in the socket connector, and the spring arm is bent and stays bent in the fully inserted position of the connectors. Such bent condition of the safety member is not desirable for certain applications. In terms of structural differences to invention, the plug projection does not comprise a pair of recesses that face the respective locking arms. Also a pair of cross ribs is not provided in the plug projection. The locking arms extend upwardly and have locking shoulders at half the length thereof and a wedge-shaped crest at the free end thereof. The locking leg of the secondary locking device extends downwardly and has a wedge-shaped projection at its free end and a step arranged in a small distance thereto. The plug connector housing has a locking projection which cooperates with the step and the projection of the spring arm for deflecting the spring arm and getting past the wedge-shaped crest projecting from the locking arm when the connectors are mated. There is no cooperation with inner walls of the socket connector for deflecting the spring arms of the secondary locking device.

With EP 2 026 421 A1 an airbag connector is known that avoids the bent condition of the safety member in the fully inserted position of the connectors. The plug connector has a housing being formed with a body portion, a cylindrical plug projection and a pair of latch arms. The latch arms extend downwardly and have a lug at its end for cooperation with a radial groove in the socket connector. The CPA member comprises a pair of locking legs which can block the latch arms of the plug connector when the same is fully inserted in the socket connector. The CPA member also comprises a pair of spring arms each with a free end that rests on a cross rib of the plug connector housing in the pre-locked position. Free end lugs of the spring arms are provided with camming surfaces which cooperate with inner walls of the socket connector when the plug connector is inserted into the socket connector so that the free end lugs of the spring arms get past the cross rib and snap into spaces behind the inner walls of the socket connector without any stresses remaining. Whereas the connector assembly described fulfill a great number of requirements on the market, there are still some improvements for the connectors in question. The plug connector has to be shipped, which is done in the pre-locked position of the CPA member, wherein the plug connector is separated from the socket connector. In view of the tendency to miniaturization, the plug connector includes tiny members as the spring arms of the CPA member. The connector could be subjected to forces in connection with shipping or handling that could lead to the spring arms being bent excessively so that correct mounting of the plug connector in the socket connector would be impaired.

SUMMARY OF THE INVENTION

It is an object of invention to design an electrical connector assembly for an automotive airbag restrained system which avoids the drawbacks discussed.

It is a further object of the invention wherein the CPA member can be held in the plug connector in a pre-locked position well in excess of mating forces.

It is another object of the invention to avoid damages on the CPA member, even if excessive forces act onto the CPA member.

It is still another object of the invention to have the latching or locking members in an essentially relaxed condition when the plug and the socket connectors are fully mated.

The plug connector of invention comprises a plug housing, terminal means in the plug housing, a cover and a CPA member. The plug housing is formed with a body portion, a cylindrical plug projection and a pair of latch arms. The CPA member comprises a pair of locking legs and a pair of spring arms, each of which has a free end formed with a lug, and a midway portion formed with a nose that projects inwardly of the device. The cylindrical plug portion has a hollow wherein the spring arms of the CPA member are accommodated, a pair of recesses facing the latch arms, and a pair of cross ribs. The latch arms which extend downwardly from the plug connector housing into the socket connector housing when the connectors are mated, each have a lug at its end for cooperation with an appropriate groove in the socket connector. The body portion of the plug housing also has a support portion for the nose at each spring arm of the CPA member. The nose has such a distance from the free end surface of the spring arm that, when the CPA member is inserted in the plug connector with the free end surface of the spring arms resting on the cross rib, the lower surface of the nose keeps a short distance to the support portion. This allows the spring arms to straddle and getting past the respective cross ribs, when the plug connector is inserted into the socket connector, without the nose getting in contact with the support portion of the plug connector. On the other hand, when the CPA member is inserted into the plug connector for taking the pre-locked position for shipment, the support portion may form a stop for the nose and therefore also for the CPA member when there is a load well in excess of the mating force onto the CPA member in a direction inwardly of the plug connector.

Alternatively or additionally to providing the support portion of the connector housing, the cross ribs may be constructed in split shape in order to provide a frictional passage for the spring arms of the CPA member, when the CPA member is in the pre-locked position and an excessive force is placed upon the CPA member. If the CPA member has prior to mating been forced through the split between the cross ribs, the housing assembly can be prepared. In preparing for mating the plug connector and the socket connector, by withdrawing the CPA member outwardly to reach the pre-locked position of the plug connector, where the free end lugs of the spring arms get out of the frictional passage between the split in the cross ribs.

Thus, the invention keeps the possibility of fully inserting the plug connector and the CPA member into the socket connector, whereas in the pre-locked position of the CPA member and the plug connector during shipment, damaging of the spring arms of the CPA member due to excessive forces is prevented.

BRIEF DESCRIPTION OF THE DRAWINGS

An embodiment of the present invention will be described by way of example with reference to the accompanying drawings in which.

DETAILED DESCRIPTION

Figure 1:
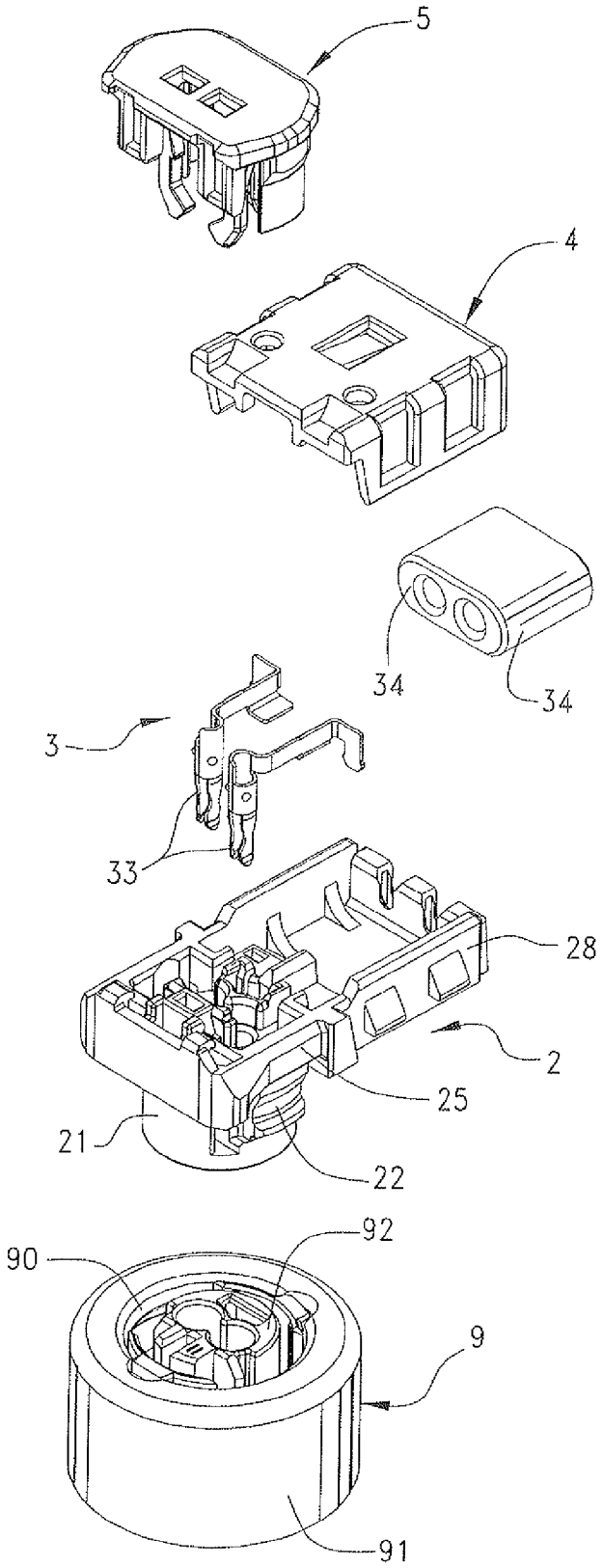
FIG. 1 is a perspective view of the components of a plug connector and a socket connector.
Figure 2:
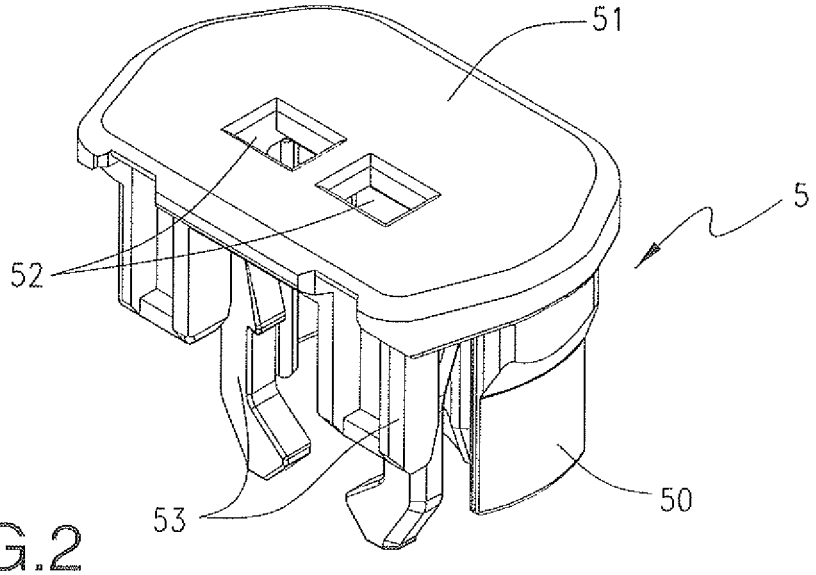
FIG. 2 through FIG. 5 are perspective views onto a CPA member.
Figure 3:
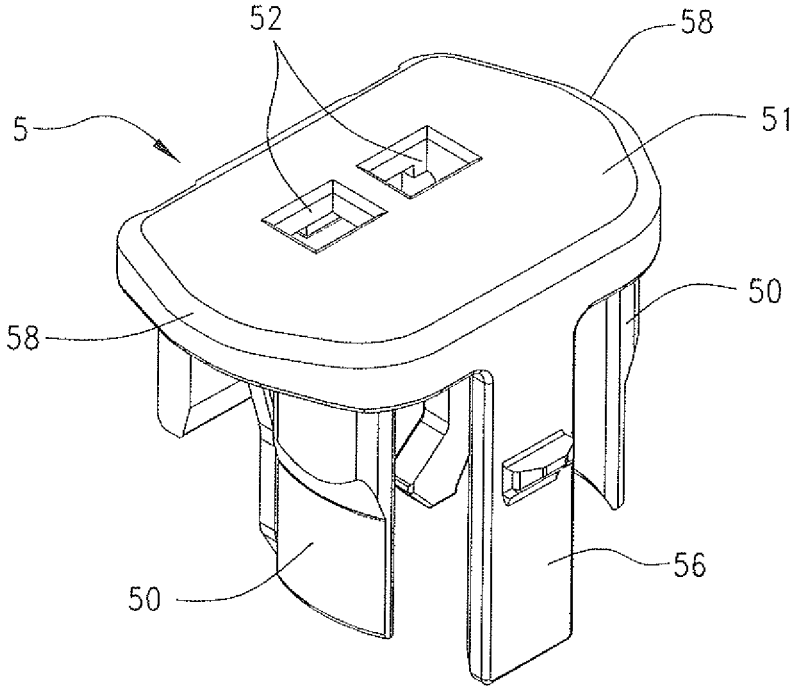
Figure 4:
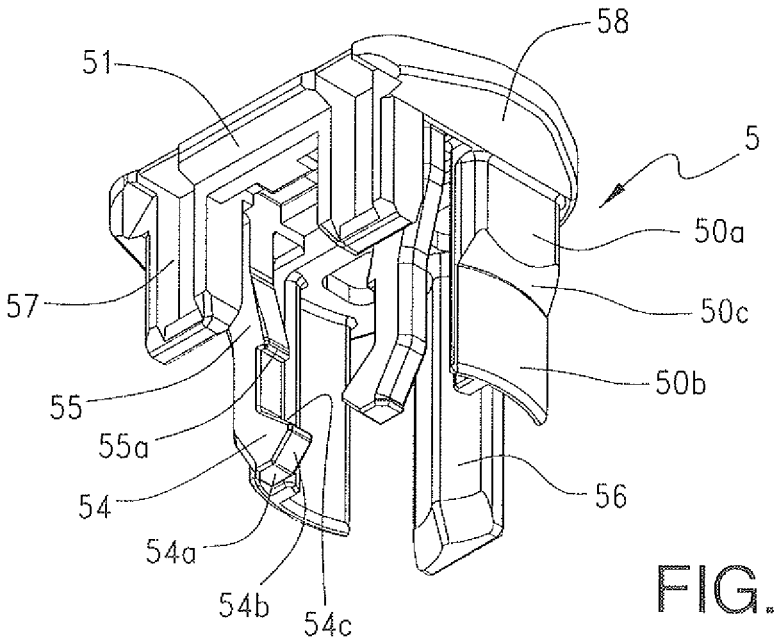
Figure 5:
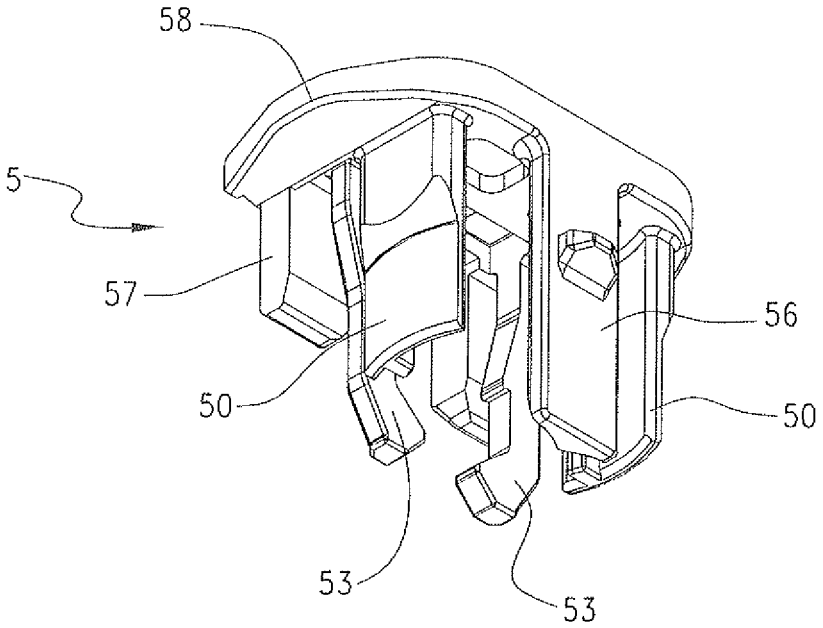
Figure 14:
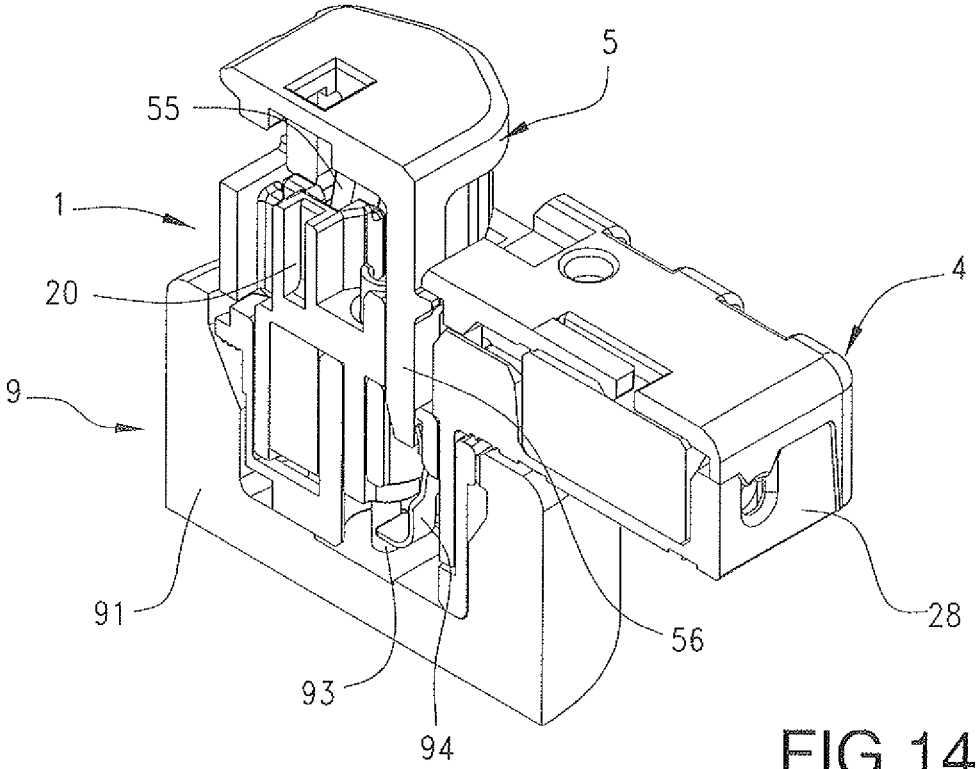
FIG. 14 is a perspective sectional view in longitudinal direction through the plug connector and socket connector before being mated.
Figure 15:
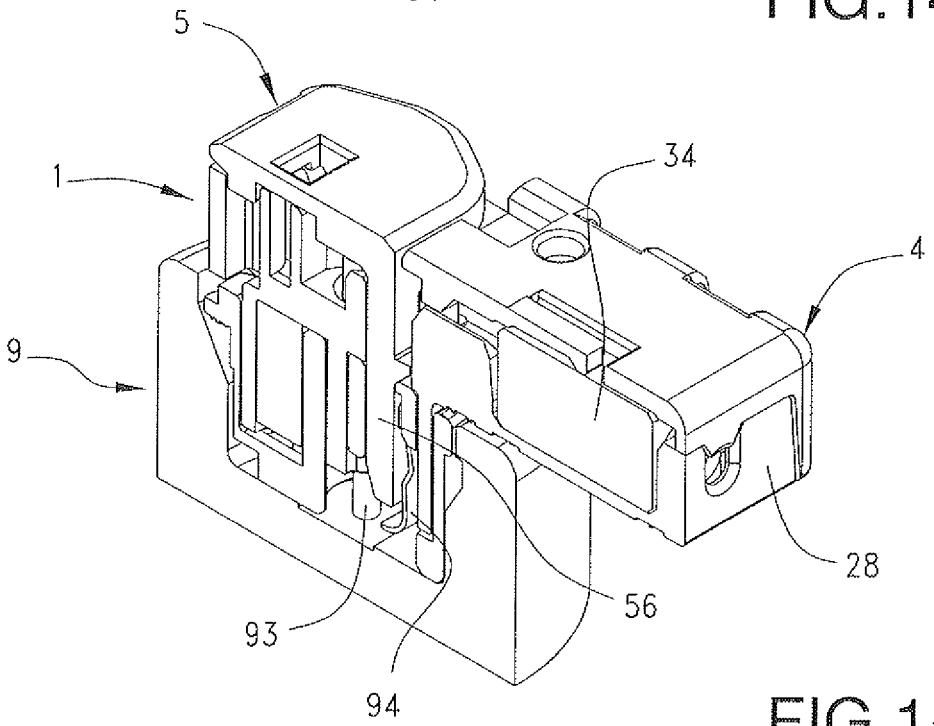
FIG. 15 is a perspective sectional view through the plug connector and socket connector when mated.
Figure 16:
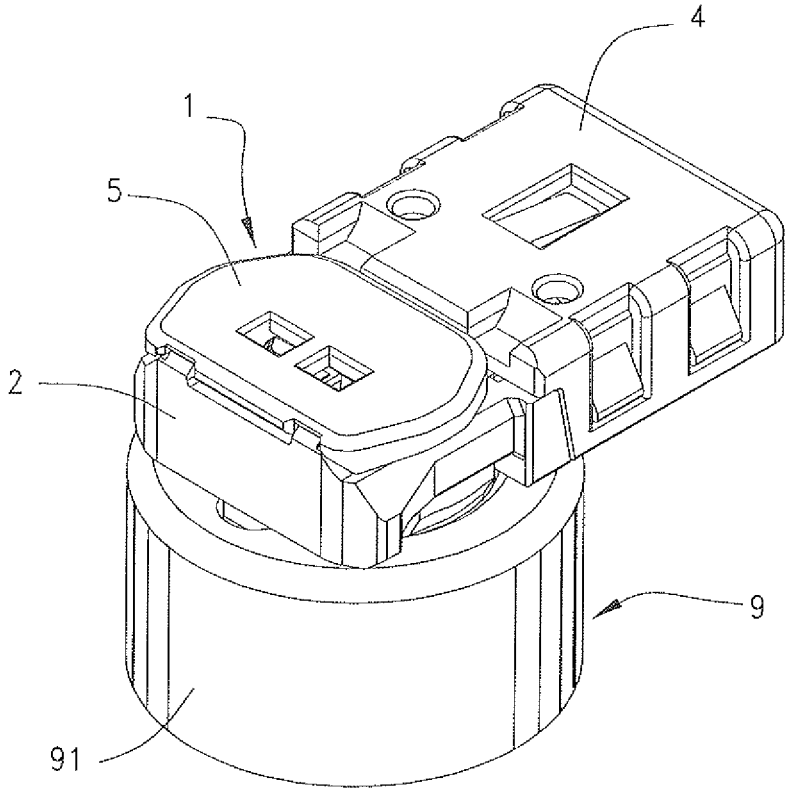
FIG. 16 is a perspective view onto a plug connector and a socket connector mated.

FIG. 16 shows a plug connector 1 and a socket connector 9 in their mated condition. The main components of the plug connector 1 are shown in FIG. 1, namely a housing 2, a terminal assembly 3, a cover 4 and a CPA member 5. The socket connector 9 includes an outer housing 91 having a hollow 90, an insert housing 92, terminals 93 (FIGS. 12, 13) and a shorting clip 94 (FIGS. 14, 15). The terminal assembly 3 includes terminal contacts 33, ferrite elements 34 and respective conductors (not shown) that lead through the ferrite elements 34 to the terminals 33.

FIGS. 2 through 5 show the CPA member 5 from different sides. The CPA member 5 has a pair of locking legs 50 connected by a plate 51 with openings 52 used in the manufacturing process. The locking legs 50 depend perpendicularly from opposite sides of the plate 51 and are parallel to one another and to the insertion direction of the CPA member. From the other opposed sides of the plate 51, a pair of guiding plates 57 and an actuator leg 56 extend also in the insertion direction of the CPA member 5. A pair of spring fingers 53 is arranged respectively behind the guiding plates 57. Each spring finger 53 has a free end lug 54 and a nose 55 at a predetermined distance to the free end approximately midway the length of the spring arm 53. The side of the plate 51 where the locking legs 50 depend are provided with grip rims 58 for handling the CPA member 5. Each of the locking legs 50 has a guiding leg portion 50*a*, a locking leg portion 50*b* which is of rounded shape, and a slanting step 50*c* between the guiding leg portion and the locking leg portion. The free end lugs 54 of the spring arms 53 each has a flat end surface 54*a* and cam surfaces 54*b*, 54*c*. The nose 55 is provided with a stop surface 55*a*.

Figure 6:
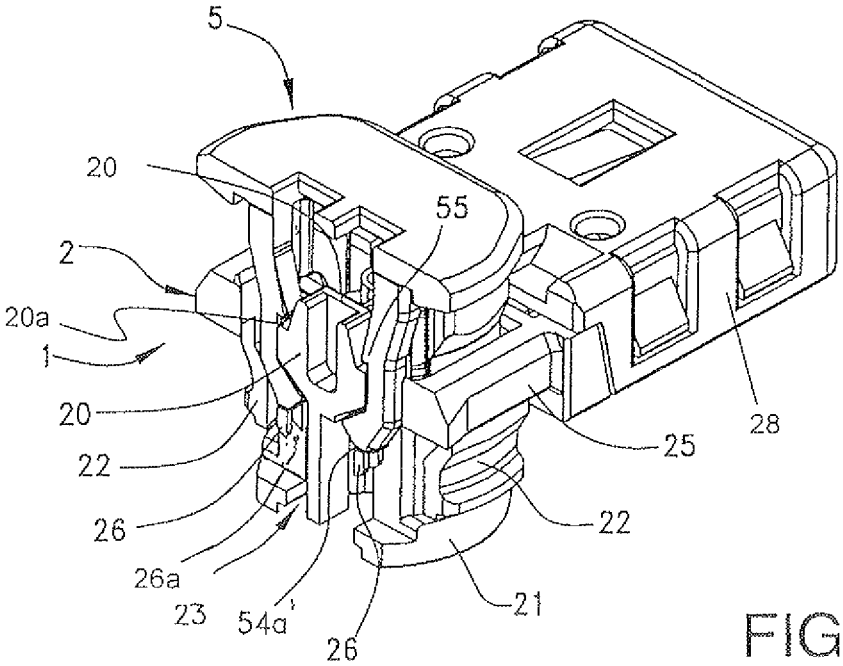
FIG. 6 is a perspective sectional view onto a plug connector in its pre-locked position.
Figure 7:
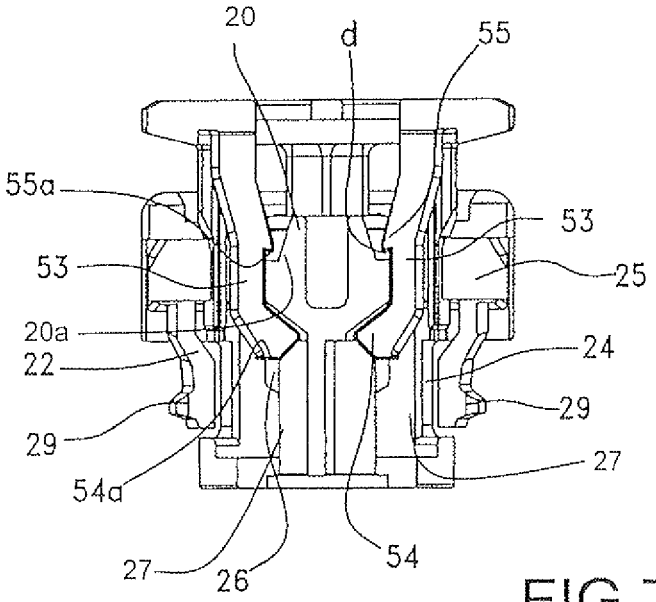
FIG. 7 is a sectional view of the plug connector in its pre-locked position.
Figure 9:
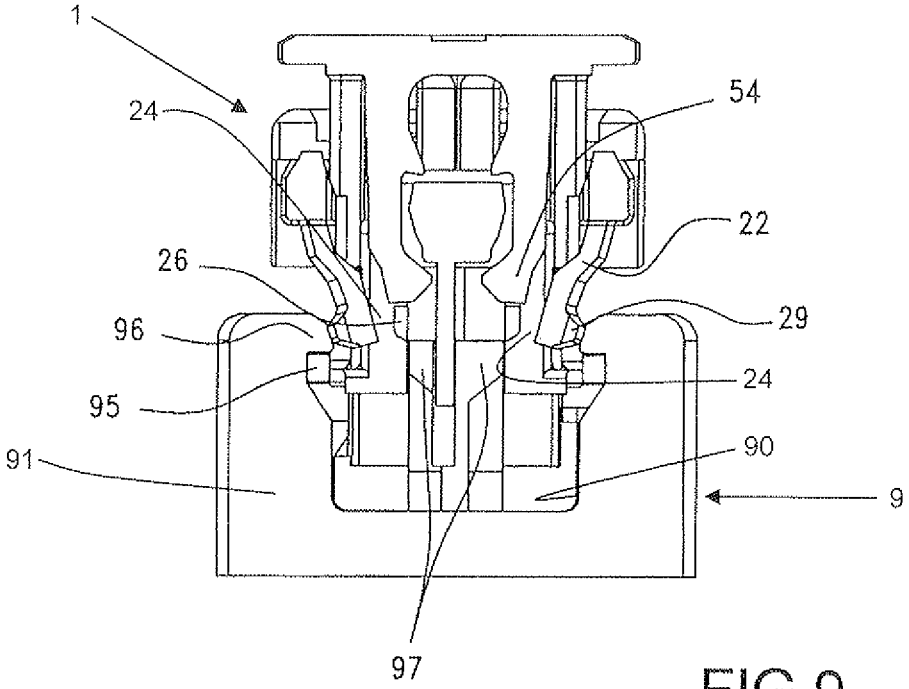
FIG. 9 is a sectional view of the plug connector and the socket connector in their pre-mounted position.

With reference to FIGS. 6 and 7, the plug connector 1 has a plug housing 2 which is formed with a body portion 20, a cylindrical plug projection 21 and a pair of latch arms 22 with each a lug 29 at the ends of the arms 22. Facing the latch arms 22, a pair of recesses 24 is provided in the walls of the cylindrical plug projection 21 so that the lower portions of the latch arms 22 can pivot into these recesses 24 in the process of mating the connectors 1 and 9 (FIG. 9). Furthermore, a casing structure 25 is provided which has a rear extension 28 for accommodating the ferrite elements 34. There is a gap between the upper rim of the cylindrical plug extension 21 and the casing structure 25 wherein portions of the CPA member 5 are clamped in the fully mated condition of the connectors 1 and 9.

The cylindrical plug projection 21 has a hollow 23 for accommodating the lower portions of the CPA member 5, and a pair of split cross ribs 26 which extend from parallel walls 27 extending vertically in the hollow 23. Each split cross rib 26 forms a gap 26*a* that offers a frictional passage for the respective end lug 54 of the respective spring arm 53.

The body portion 20 has an upper support surface 20*a* to which the nose 55 of the spring arm 53 keeps a short (vertical) distance d when the plug connector 1 together with the CPA member 5 takes the pre-locked position which is shown in FIGS. 6 and 7. In this condition, the flat free end surface 54*a* of the CPA spring arm 53 is engaged by the flat upper surface of the cross ribs 26 and is held in place as shown with the distance d between the surfaces 55*a* and 20*a*. In this pre-locked position, the plug connector 1 is prepared for being shipped. If in this condition loads well in excess of the mating force are placed upon the CPA member 5, for example in connection with shipping or handling, the nose 55 finds a stop on the support surface 20*a* so that the CPA member 5 is kept in the pre-locked position.

Furthermore, if the excessive forces placed upon the CPA member 5 are greater than what the nose 55 against the support surface 20*a* can support, the split cross ribs 26 prevent damage to the tiny spring arms 53. This is accomplished by the transfer of the excessive force on the CPA member 5 to the free end surface 54*a* which pushes against the split cross ribs 26, causing the parallel walls 27 to deflect outward, increasing the gap 26 *a* between the cross ribs until the spring arms 53 can pass without damage through the passage so created. The CPA member 5 can still be used by being pulled up into the prelocked position without having been damaged. During the mating process, the cross ribs 26 do not separate due to the walls 27 being supported by a wall in the insert housing 92.

The stop surface 55*a* and the support surface 20*a* opposite the stop surface 55*a* are parallel to one another and may extend perpendicularly to the insert direction, or slope inwardly relative to the plug connector 1. This makes sure that the spring arm 53 does not move away from the body portion 20 when there is a force well in excess of mating forces onto the CPA member 5 from above, the nose 55 keeping the spring arm 53 closely to the body portion 20.

Figure 8:
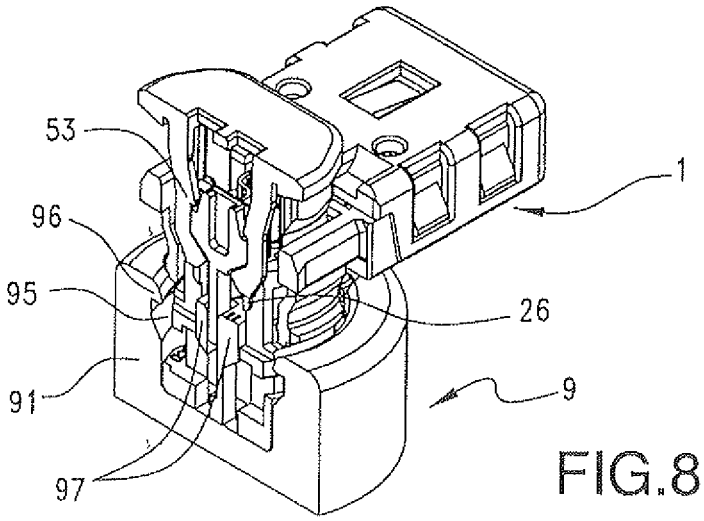
FIG. 8 is a perspective sectional view of a plug connector and a socket connector in their pre-mounted position.

FIGS. 8 and 9 show the plug connector 1 and the socket connector 9 in the pre-mounted position which is the position just before finally mating the connectors 1, 9. In the interior 90 of the socket housing 91, a circumferential groove 95 is provided so that an inner flange rim 96 is formed. The respective lugs 29 at the lower ends of the latch arms 22 get in contact with this circular rim 96 and are clamped at the flange rim 96 when the plug connector 1 is somewhat inserted into the socket connector 9. When doing so, the lower portions of the latch arms 22 move into the recesses 24.

Figure 10:
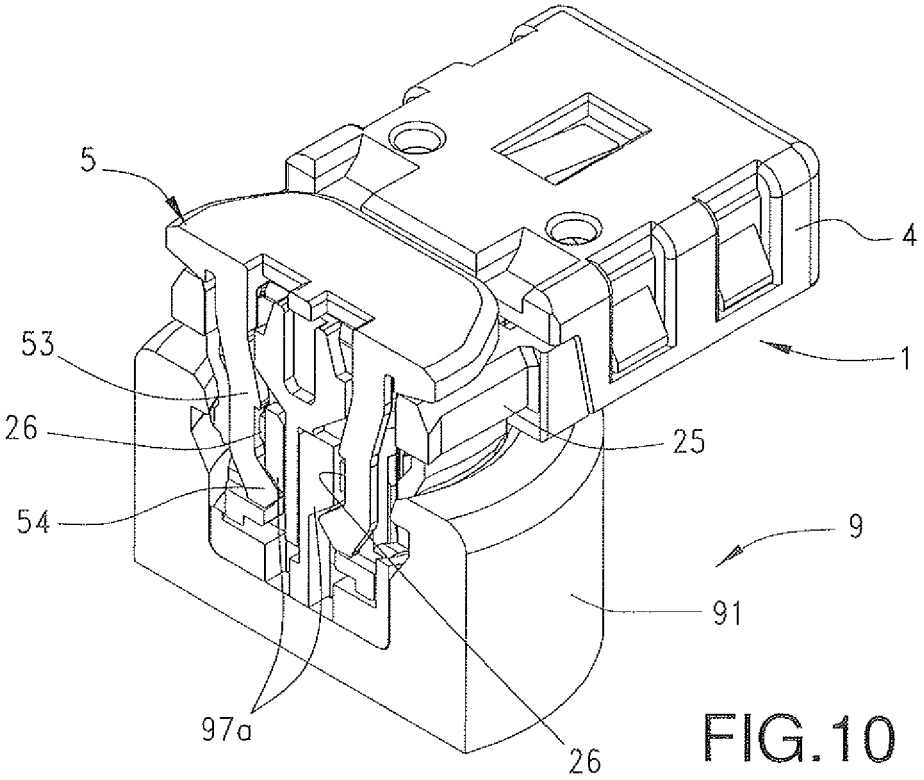
FIG. 10 is a perspective sectional view of the plug connector and socket connector in the mated position.
Figure 11:
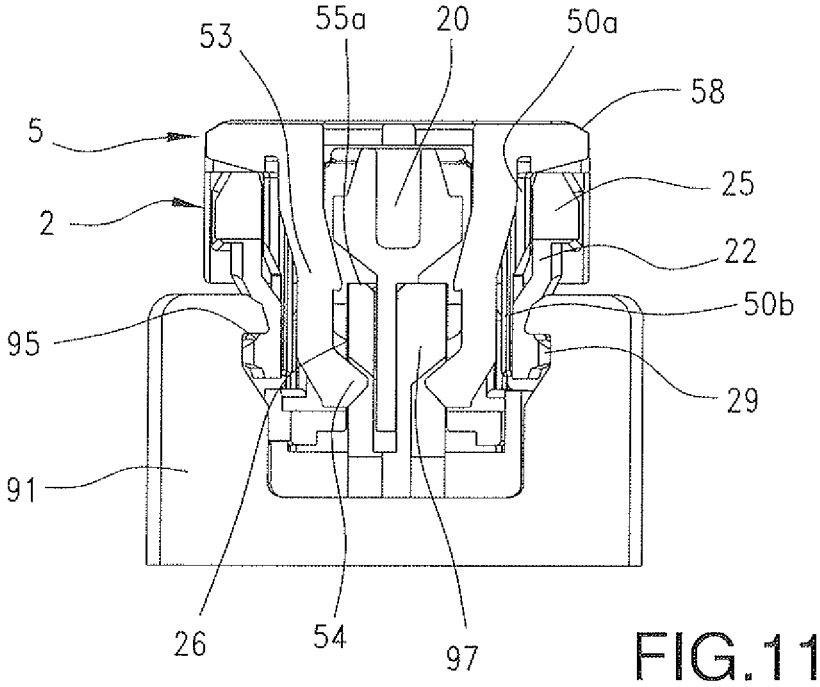
FIG. 11 is a sectional view of the plug connector and socket connector in the mated position.

Final mating of the connectors 1, 9 is started from this situation of the pre-mounted position. As shown in relation of FIGS. 8, 9 to FIGS. 10, 11, the plug connector 1 together with the CPA member 5 are further pressed downwardly into the socket connector 9 so that the lugs 29 of the latch arms 22 snap into the groove 95 and fix the connector housing 2 relative to the socket connector housing 91. By this insertion movement of the CPA member 5, the end lugs 54 of the spring arms 53 hit against inner walls 97 of the socket housing 91 and the slanting cam surfaces 54*b* of the lugs 54 engage the respective upper surfaces of the inner walls 97 so that the spring arms 53 are spread apart, and when the CPA member 5 is further pressed downwardly, the lugs 54 at the free ends of the spring arms 53 get past the cross ribs 26 as shown in FIGS. 10 and 11. Furthermore, the lugs 54 get behind lower cam surfaces 97*a* of the inner walls 97, while the lower nose surfaces 55*a* are close to the upper flat surfaces of the walls 97. Simultaneously with completely inserting the CPA member 5 in the plug connector housing 2, the locking portion 50*b* of the locking legs 50 fill the gap or recess 24 behind each latch arm 22 which are blocked by this action and cannot get out of the groove 95. Furthermore, the respective guiding portions 50*a* of the locking legs 50 are clamped between the upper rim of cylindrical plug projection 21 and the casing structure 25. The mated condition of the connectors 1 and 9, therefore, is strongly fixed by this secondary locking means or CPA member 5.

For un-mating the connectors 1, 9, the CPA member 5 is gripped at the grip rims 58 and lifted. By doing so, the lugs 54 of the spring arms 53 slide along the slanting surfaces 97*a* and the spring arms 53 are spread apart. Simultaneously, the locking leg portions 50*b* leave their locking positions so that the lugs 29 are no more blocked. In this condition, the plug connector 1 can be drawn from the socket connector 9 against the latching force of the latch arms 22.

Figure 12:
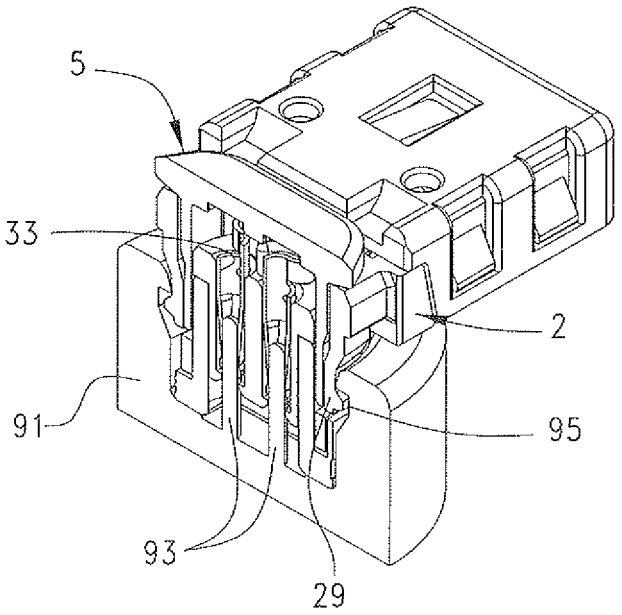
FIG. 12 is a perspective sectional view of the plug connector and socket connector taken through the terminals.
Figure 13:
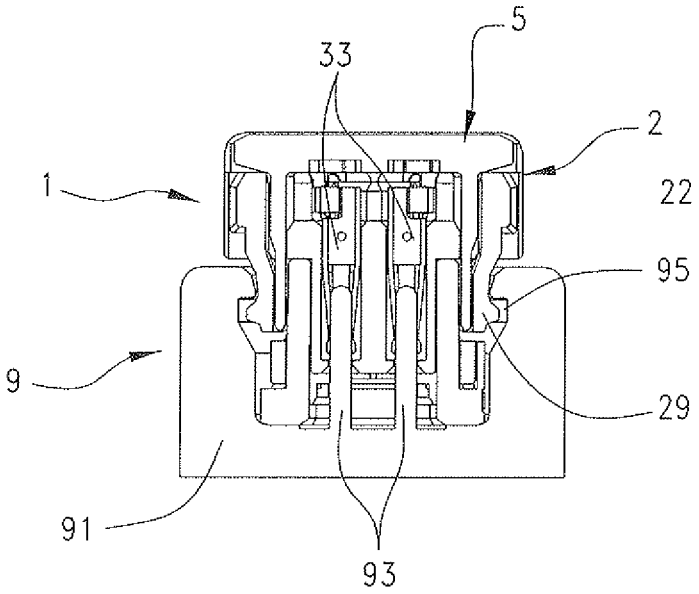
FIG. 13 is a sectional view through the plug connector and socket connector taken through the terminals.

FIGS. 12 and 13 show another section across plug and socket connectors through the terminals 33 and 93. As already explained, the plug connector 1 is safely locked in the socket connector 9 with the lugs 29 of the latch arms 22 locked in the groove 95.

For reasons on electrical safety of the airbag, the socket connector 9 is short-circuited by a shorting clip 94 (FIG. 14) which bridges the socket connector terminals 93 (only one terminal 93 is shown in FIG. 14) when the plug connector 1 is not fully inserted in the socket connector 9. FIG. 15 shows the actuator leg 56 lifting off the shorting clip 94 when the CPA member 5 is depressed and the fully mated condition is reached.

What is claimed is:

1. A plug connector for cooperation with a socket connector, comprising:

a plug housing for accommodating terminal means, a cover for closing the plug housing, and a CPA member for locking the connectors when mated;

the plug housing being formed with a body portion, a cylindrical plug projection and a pair of latch arms;

the cylindrical plug projection having a hollow for accommodating portions of the CPA member, a pair of recesses facing the latch arms, and a pair of cross ribs;

the latch arms, each having a lug at its end for cooperation with an appropriate groove in the socket connector;

the CPA member comprising a pair of locking legs and a pair of spring arms, each having a free end lug and a nose which projects inwardly and is arranged in a predetermined distance from a spring arm end surface so that, when the CPA member and the plug connector are in a pre-locked position, the spring arm end surface is engaged by a flat upper surface of the cross ribs and the nose takes a short distance to a support surface, and when there are loads well in excess of mating force onto the CPA member in this condition, the noses make a stop on the support surface to keep the CPA member in the pre-locked position, whereas when the plug connector and the socket connector are in a pre-mounted position and there is a mating operation onto the plug connector and the CPA member, the free end lugs of the spring arms cooperate with inner walls of the socket connector to straddle the spring arms and keep the noses free from the support surface so as to allow the lugs getting past the respective cross ribs and to mate the plug connector with the socket connector.

2. The plug connector of claim 1, wherein the nose has a stop surface which extends perpendicularly to the insertion direction of the CPA member in the plug connector, or slopes inwardly relative to the plug connector, the stop surface, which extends perpendicularly to the insertion direction or slopes inwardly relative to the plug connector, in case of an excessive load onto the CPA member, cooperating with the supporting surface of the body portion.

3. The plug connector of claim 1, wherein each free end lug forms a flat end surface of the spring arms for resting upon the respective cross rib, the free end lugs also comprising cam surfaces which cooperate with inner walls of the socket connector and with the cross ribs, respectively, when mating and unmating the connectors.

4. The plug connector of anyone of claim 1, wherein the cross ribs are arranged between respective parallel walls in the hollow of the plug projection.

5. The plug connector of claim 4 wherein each cross rib is split to form a gap therebetween which offers a frictional passage for the respective free end lug of the respective spring arm when an excessive force is placed upon the CPA member.

6. The plug connector of anyone of claim 1, wherein each spring arm between the nose and the free end lug has a contour that encompasses the inner wall top ends of the socket connector.

7. The plug connector of claim 6 wherein the latch arms have a first length and the spring arms have a second length longer than the first length so that in the mated condition of the connectors, the free end lug of each spring arm extends deeper in the socket connector than does the end lug of each latch arm.

8. The plug connector of anyone of claim 1, wherein the locking legs of the CPA member each has a guiding leg portion, a locking leg portion and a slanting step therebetween, the guiding leg portions clamping the CPA member between casing walls of the plug housing.

9. The plug connector of anyone of claim 1, wherein the CPA member includes a plate defining a plate plane that extends perpendicularly to the insertion direction of the CPA member and wherein guiding walls defining a guiding plane and the spring arms extend parallel to one another and depend from said plate in a direction parallel to the insertion direction, the pairs of locking legs defining parallel leg planes which extend perpendicularly to the guiding plane of the guiding walls.

10. The plug connector of claim 9, wherein the plate of the CPA member is basically rectangular having two pairs of opposed sides, one side pair, where the locking legs depend from the plate, being extended with grip rims, the other side pair being provided with the guiding walls and an actuator leg, respectively, which depend from opposed sides of the plate.

11. A plug connector for cooperation with a socket connector, comprising:

a plug housing for accommodating terminal means,
a cover for closing the plug housing, and
a CPA member for locking the connectors when mated;
the plug housing being formed with
a body portion,
a cylindrical plug projection and
a pair of latch arms;
the cylindrical plug projection having a hollow for accommodating portions of the CPA member, a pair of recesses facing the latch arms, and a pair of cross ribs; each cross rib is split to form a gap therebetween;
the latch arms, each having a lug at its end for cooperation with an appropriate groove in the socket connector;
the CPA member comprising
a pair of locking legs and
a pair of spring arms, each having a free end lug so that, when the CPA member and the plug connector are in a pre-locked position and when an excessive force is placed upon the CPA member said free end lugs push against the split cross ribs and deflecting them further apart and providing a frictional passage permitting the spring arms to pass into the gap without damage.

12. The plug connector of claim 11 wherein said socket connector includes an insert housing; and said cross ribs are prevented by said insert housing from deflecting apart to permit passage of the spring arms during the mating process.

* * * * *